United States Patent [19]
Sides et al.
[11] 4,290,492
[45] Sep. 22, 1981

[54] IDLING AND AIR REPLENISHING SYSTEM FOR A RECIPROCATING HAMMER MECHANISM

[75] Inventors: Daniel H. Sides, New Freedom, Pa.; Hanspeter E. Beisch, Belair, Md.

[73] Assignee: Black & Decker Inc., Newark, Del.

[21] Appl. No.: 8,228

[22] Filed: Jan. 31, 1979

[51] Int. Cl.[3] ..... B25D 11/12; B25B 45/04
[52] U.S. Cl. ..... 173/118
[58] Field of Search ..... 173/14, 116, 118, 128, 173/133; 60/370, 371, 408; 92/224

[56] References Cited

U.S. PATENT DOCUMENTS

| | | | |
|---|---|---|---|
| 2,283,292 | 5/1942 | Smith, Sr. | 173/118 X |
| 3,032,998 | 5/1962 | Atkinson | 173/118 |
| 3,405,610 | 10/1968 | Hill et al. | 92/224 |
| 3,559,751 | 2/1971 | Yamada | 173/116 |
| 3,688,848 | 9/1972 | Vick et al. | 173/116 |
| 3,874,460 | 4/1975 | Schmid et al. | 173/116 X |

FOREIGN PATENT DOCUMENTS

| | | | |
|---|---|---|---|
| 3153 | of 1914 | United Kingdom | 173/118 |

*Primary Examiner*—Andrew V. Kundrat
*Assistant Examiner*—Andrew M. Falik
*Attorney, Agent, or Firm*—Harold Weinstein; Leonard Bloom; Edward D. Murphy

[57] ABSTRACT

An improved air replenishing and idling system for a reciprocating hammer type tool having an outer housing and reciprocal drive mechanism, comprising an elongated barrel mounted within that housing. The barrel includes an axially disposed, air passageway. Slideably positioned within the barrel is a piston member which includes a closed end portion and a hollow, tubular forward portion having first and second air passageways. The piston is reciprocally moved within the barrel by the drive mechanism. Slideably positioned within the hollow tubular portion of the piston is an impact ram. In the operational mode, the ram, tubular portion of the piston member, and barrel cooperate to seal or expose the first and second air passageways and provide a communicative path to the "outside" air through the barrel air passageway whereby the ram is urged axially towards and away from the tool bit through the pressure differentials created. Further, in the idling mode, the first and second air passageways and the barrel passageway insure that the ram is inactive when the tool bit is removed or when the tool is lifted from the work surface.

5 Claims, 8 Drawing Figures

IDLING AND AIR REPLENISHING SYSTEM FOR A RECIPROCATING HAMMER MECHANISM

FIELD OF THE INVENTION

The present invention relates generally to reciprocating hammer mechanisms and more particularly, to an improved idling and air replenishing system for same.

BACKGROUND OF THE INVENTION

Reciprocating power hammers are either of the double air cushion or spring design or single air cushion design. The former type of tool is described in U.S. Pat. No. 1,191,948 and German Pat. No. 255,977 issued in 1918 to Heinrich Christiansen. Pertinent single air spring designs are described in U.S. Pat. No. 2,880,585 and U.S. Pat. No. 3,688,848, assigned to The Black and Decker Manufacturing Company, the assignee herein.

The double air spring device as understood by the inventors herein, does not afford an idling arrangement when the tool is disengaged from the work surface or when the tool bit is removed from the unit. In the aforementioned single air spring designs relatively intricate air transfer systems are described for accomplishing air replenishing and idling. These necessitate the machining of the piston and surrounding guide tube to provide appropriate grooves and annular cut outs to effect the required air transfer.

The fact that these prior art systems require that the piston and guide tube employ grooved surfaces, results in reduced reliability in that excessive wear results, for example, on the piston sealing ring which is continually reciprocated past the grooves cut in the guide tube.

Further, because of the need to machine these surfaces so as to provide this intricate grooving, the thickness of the starting material for the piston and the guide tube must be sufficiently adequate to allow for the cutting of the grooves. Further, the material for the piston, guide tube and ram must be sufficiently hard so as to provide long wear and thus extend the reliability of the unit. For example, the design of the '848 patent employed steel for the piston and tube members. The heavier the material used in this air unit, the greater the vibrational effects resulting from the continuous reciprocation of the piston and the striking of the ram against the tool bit.

Further, in the '848 patent, for example, the ram or striker is typically an intricately machined part. This is so because it is one of the cooperating members in the air transfer system.

It is therefore a primary object of this invention to provide an improved air replenishing and idling system which employs easily machined, cooperating parts.

It is yet another object of this invention to employ lighter weight material so as to reduce the shock and vibration experienced by the operator.

It is still another object of this invention to provide an air transfer system which allows for easy achievement of an idle mode when the tool bit is removed or the mechanism lifted off the surface being worked.

SUMMARY OF THE INVENTION

Towards the accomplishment of the aforementioned objects and others which will become apparent from the following description and accompanying drawings, there is disclosed an improved air transfer system for a reciprocating hammer mechanism including a housing, and reciprocal drive means, the system comprising an elongated barrel, mounted within the housing, having axially disposed air passageway means. A piston member is slideably positioned within the barrel, the member including a closed rear end portion and a hollow, tubular, forward portion having first and second air passageways drilled therethrough. The first passageway is axially disposed in the tubular portion of the piston in a prescribed relation to the second passageway. Positioned within the tubular portion of the piston member is a ram. The ram is adapted to deliver an impact blow to a beat piece axially aligned with the ram and slideably mounted within the housing, forward of the elongated barrel. The ram includes a substantially continuous peripheral portion which sealingly engages the inner wall of the tubular portion of the piston. The ram thus forms an air tight enclosure, within said piston, between its peripheral portion and the rear end of the piston.

The axial relationship between the barrel air passageway means and the first and second air passageways in the tubular portion of the piston member are such that the first air passageway communicates with the barrel air passageway means when the piston member is urged towards its forward limit by the drive means connected thereto, thus replenishing the air lost from the enclosure between the ram and the piston end wall. The second passageway communicates between the barrel passageway means and the enclosure formed between the ram peripheral portion and the end portion of the piston, when the beat piece is moved forward within the housing and out of range of the ram. This happens in the idle mode, which occurs when the tool bit is removed or when the tool is lifted from the surface being worked.

BRIEF DESCRIPTION OF THE DRAWINGS

The drawings to be considered in discussing the invention are as follows.

DESCRIPTION OF THE PREFERRED EMBODIMENT

Figure 1:
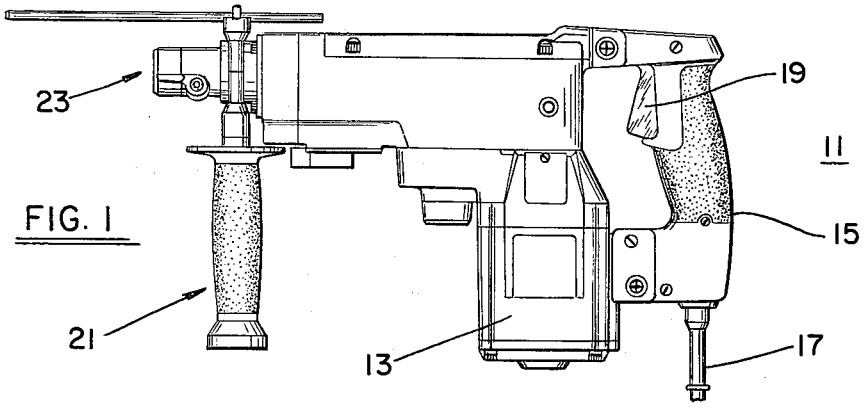
FIG. 1 is an elevation view of a tool which employs the present invention.

FIG. 1 depicts a portable, power tool 11 such as a reciprocating hammer mechanism, which includes a motor housing 13, operator's handle 15 to which is connected an electric power cord 17. The handle includes a trigger mechanism 19 which activates the tool in a well known manner. Towards the bit end of the tool is a steadying grip handle 21 and the bit accepting chuck 23.

Figure 2:
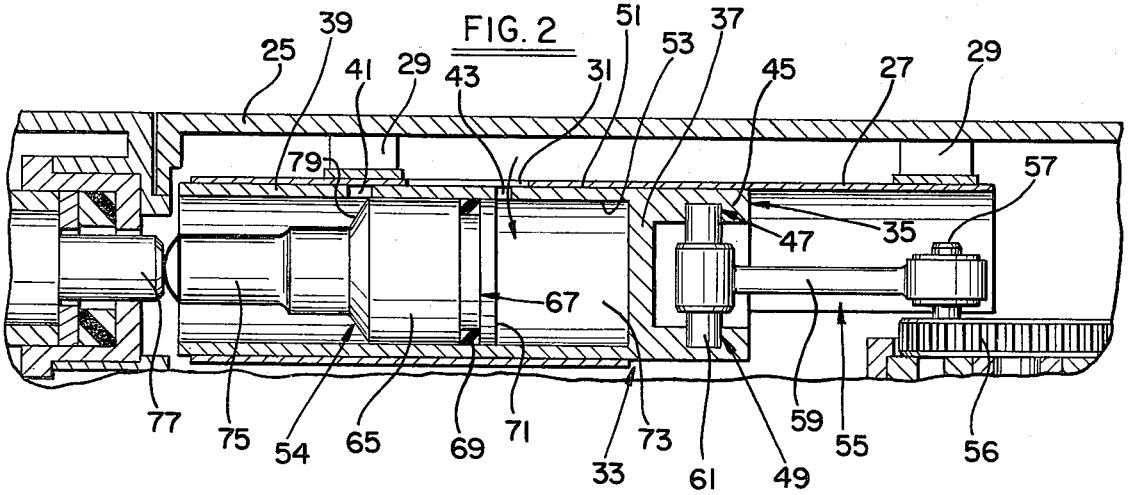
FIGS. 2 through 7 depict in section, various positions of the air transfer system mechanism in accordance with the present invention as it responds to the piston drive means.

Referring now to FIG. 2, a sectional drawing of the important part of the invention is shown. Disposed radially inwardly of housing 25 is an elongated tube or barrel 27 which is suspended from to the inside wall of the housing by brackets 29. The latter, typically, are welded to the tube 27 and are secured to the housing 25 by suitable means.

Figure 8:
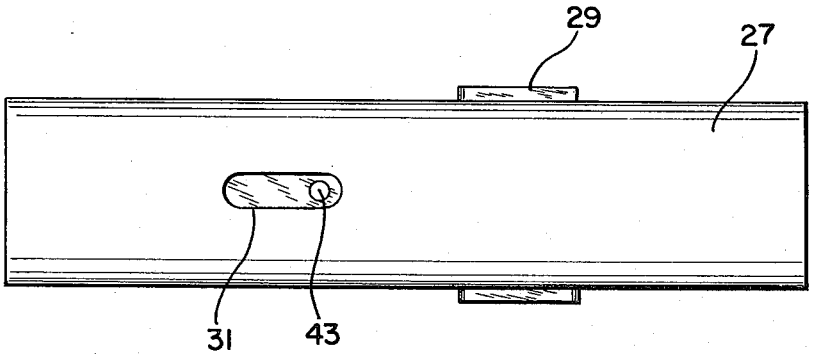
FIG. 8 shows a portion of the air transfer system of the present invention.

The tube 27 is cylindrically shaped and includes an elongated slot, 31, which is best appreciated from FIG. 8. In that view, it is seen how the slot 31 extends axially a predetermined amount along the length of the tube 27.

The length and axial location of the slot will be best understood from the discussion to follow.

A section of the tube is removed from the underside portion thereof at point 33 to afford necessary clearance with portions of the piston drive mechanism not visable in the drawings.

The tube 27 is typically manufactured from steel so as to provide necessary strength and hardness. Alternately, the tube could be manufactured from a "softer" metal, e.g., aluminum, and then hard coated with a suitable material, such as aluminum oxide.

Slideably positioned within the tube or barrel 27 is a piston member 35. It is seen to include a closed end portion 37 and an axially extending, hollow, tubular forward portion 39. The latter includes first and second, radial, thru holes 41 and 43. The axial distance between these holes is determined by the necessary, cooperative action between the various parts of the invention and is more appropriately discussed with regard to the operation of the device explained hereinafter.

The piston member is seen further to include an annular, axially extending portion 45 which has drilled therein radial holes 47 and 49.

The piston member typically, is machined from bar stock aluminum or other light weight material, for example, magnesium. Surfaces 51 and 53 which contact the cooperating surfaces of tube 27 and the striking ram 54 (described hereinafter) are coated with a suitable material so as to minimize wear. A typical coating would be aluminum oxide.

The fact that the piston member is machined from bar stock, permits use of a relatively high-strength aluminum as compared with a casting-requiring a different grade and necessarily having less desirable strength characteristics. The use of a light weight material reduces the mass of the reciprocating member. This reduces the tool vibration to a minimum during the operational mode, resulting in less operator fatigue and prolonged tool life. The piston could, of course, bemanufactured from a harder material such as steel.

Typical means for reciprocally driving the piston member 35 axially along the length of tube 27 are shown generally at 55. It includes a crank disc 56 driven by the motor (not shown) through suitable gearing (again, not shown). Disposed in a suitable notch on the perimeter of the disc 56 is crank pin 57. Connecting rod 59 is attached to the pin and to yet another pin 61 deposited in radial holes 47 and 49.

Other, conventional alternatives to the just described means for driving the piston are well known and include a scotch-yoke design, plus others, readily apparent to those skilled in the art.

Slideably positioned within the enclosure defined by the hollow tubular forward portion 39 of the piston member, is the striking ram 54. It is a relatively simple piece and includes a substantially continuous, head or peripheral portion 65. The latter includes an annular groove 67 which has sealing means such as ring 69 positioned therein.

End surface 71 of the peripheral portion cooperates with the hollow tubular portion of the piston member and the end portion 37 of the same member, to form an enclosure 73. The volume and air pressure characteristics of the enclosure change throughout the various cycles of the mechanism's operation and will be discussed hereinafter.

Extending axially in the direction towards the tool bit, is an appendage 75. This is designed to deliver an impact blow to the tool bit (not shown) through a so called beat piece 77.

The ram, as noted above, is of simple design with no special grooving or annular rings as was the case with the prior art systems. It is typically fabricated from a hard material such as steel.

The various contacting surfaces between the reciprocating members described above, will be lubricated with an appropriate oil.

OPERATION

A discussion of the operation of the above described device will now proceed with respect to FIGS. 2 through 7. It is presumed, initially, that the tool is in the non-idle or operational mode, in other words, that there is a tool bit in place and that the power hammer or the like is held by the operator against the surface to be worked.

In FIG. 2, the piston member 35 is in the fully extended position in the direction of the tool bit. That is bottom dead center. The ram 54 has been thrust towards, and is in contact with the beat piece 77, just having delivered its impact blow.

In this position, it is seen that radial hole 43 is axially disposed in relationship with slot 31 such that enclosure 73 is in communication with the "outside" air at atmospheric pressure. This is the so called replenishing cycle of the operational mode of the device. That is, air which has escaped from the enclosure 73 during the most immediate prior cycle, is replenished so that satisfactory performance in the subsequent cycle will result.

Figure 3:
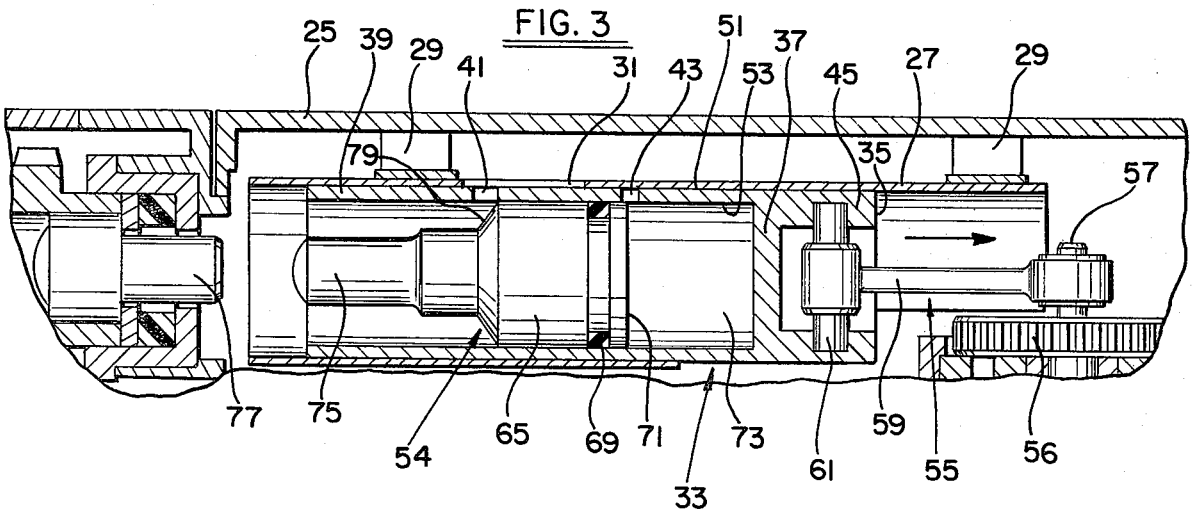

FIG. 3 depicts the next important step in the operational cycle of the device. Disc 56 rotates and consequently drives the piston member 35 to the right in tube 27 as indicated by the arrow. This portion of the cycle is shown when the piston is approximately mid way between bottom and top, dead center. The ram is rebounding from its impact blow with the beat piece 77. The ram just prior to the position depicted in FIG. 3 is travelling axially within the hollow tube portion 38 of the piston member due to its inertia after impact. At the point depicted in FIG. 3, radial hole 43 has been moved axially to a point that it is no longer disposed beneath the slot 31.

The enclosure 73 is thus sealed off from the atmosphere. At this point, the piston like member 35 is travelling in the guide tube 27 faster than the ram is travelling within the tubular portion 39. A vacuum is developing in the enclosure 73. Atmospheric pressure acting on the surface 79 of the ram now positively urges the ram in the indicated direction. The piston reaches top dead center (not shown) with the ram accelerating to the right. The enclosure 73 continues to be reduced.

The piston moves through the apex portion, of the cycle (top dead center) and begins to move to the left, again. The ram's inertia results in its continual axial movement to the right. After top dead center, opposite axial movement of the piston accelerates the reduction of volume of enclosure 73. An air spring develops.

Figure 4:
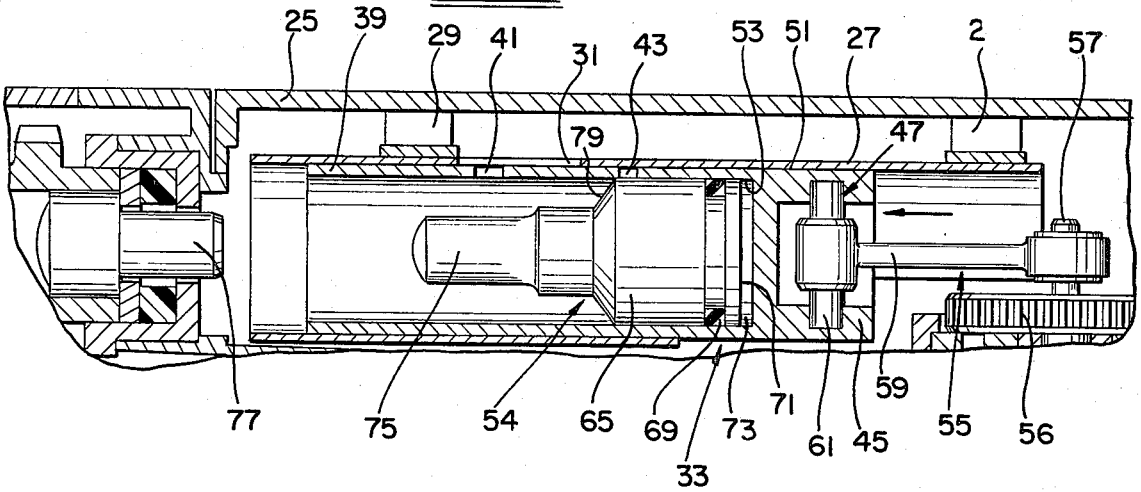

FIG. 4 depicts the portion of the operational cycle when the piston member has moved through the top dead center position and has started back to the left. Enclosure 73 is seen to have been reduced to a relatively small volume. The developed pressure in 73 decelerates the ram and then accelerates it to the left and towards the beat piece 77.

Figure 5:
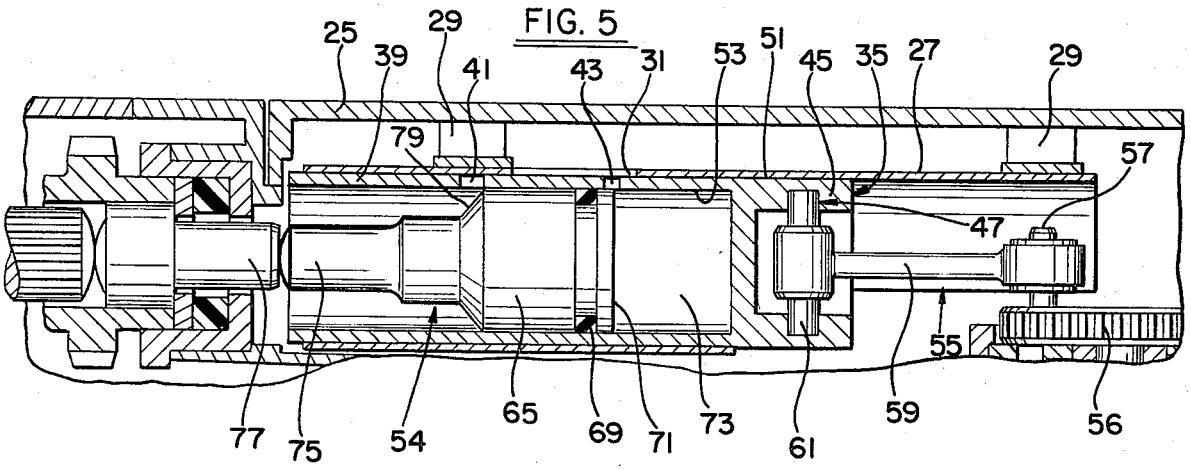

FIG. 5 is identical to previously described FIG. 2 depicting the piston member 35 in the bottom dead center position. The ram has delivered its impact blow to the beat piece 77 and the end surface 71 has passed radial hole 43, thus allowing communication between the enclosure and the outside atmosphere so as to replenish lost air.

From the discussion above with regard to the operational cycle of the tool, it is seen how radial hole 41 plays no part in the operational mode in that it is either sealed by the ram or disposed axially to the left of the peripheral portion of the ram as shown, for example, in FIGS. 2 through 5.

Figure 6:
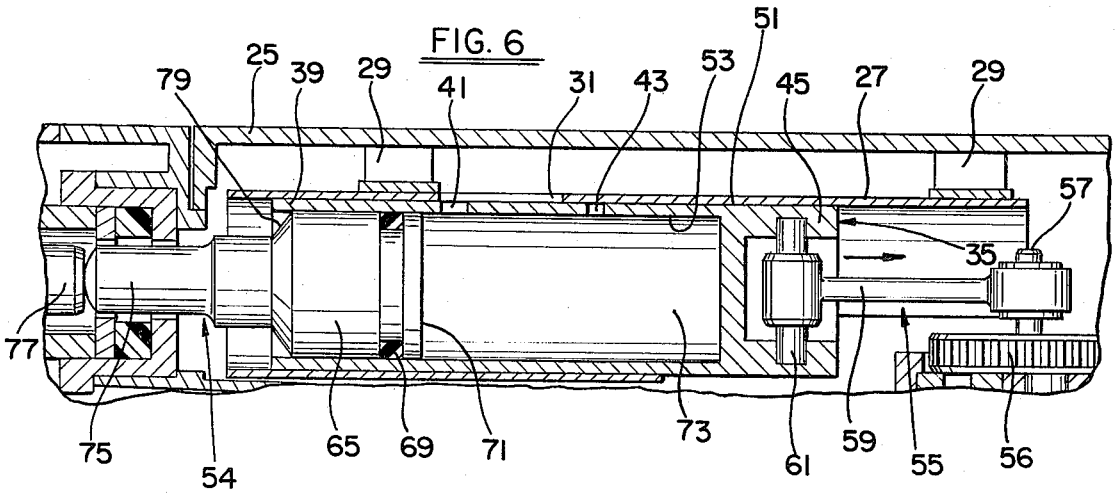

Referring now to FIG. 6, the involved elements of the invention are shown in their respective relationships when the tool is in the idle position. This occurs either when the tool bit is removed from the device or when the tool, with the bit, is lifted off of the surface being worked.

On the cycle immediately following the above described precondition, the ram 54 would be thrust in the direction of the beat piece 77 intending to deliver its impact blow. Since the tool bit has been removed or the tool lifted from the work surface, the beat piece offers no resistance and is likewise thrust forward or rather axially disposed to the left as viewed in FIG. 6 resulting in the end 71 of the ram being displaced further axially to the left than when in the operational mode. The peripheral portion is thrust beyond the point where it would seal off radial hole 41. The axial displacement of the beat piece 77 and the overall length of the ram are such that this is insured.

FIG. 6 actually shows the piston moving to the right (in that view) and approximately mid way between the bottom and top dead center. Earlier, in the bottom dead center position, although not shown, radial hole 43 would have been aligned with slot 31 thus providing communication with the "outside" air. As the piston member moves to the right, to the mid position shown, radial hole 43 is covered by tube 27. However, radial hole 41 where before, in the operational mode, it was sealed off and thus "inoperative", now is axially aligned with the slot 31.

The axial distance between the holes 41 and 43 and their cooperative, axial, relationship with slot 31 are such that there is always a "communication" between the outside air and the enclosure 73, throughout the path of piston member 35. This precludes development of a vacuum in the enclosure. Thus, the ram remains inactive.

Figure 7:
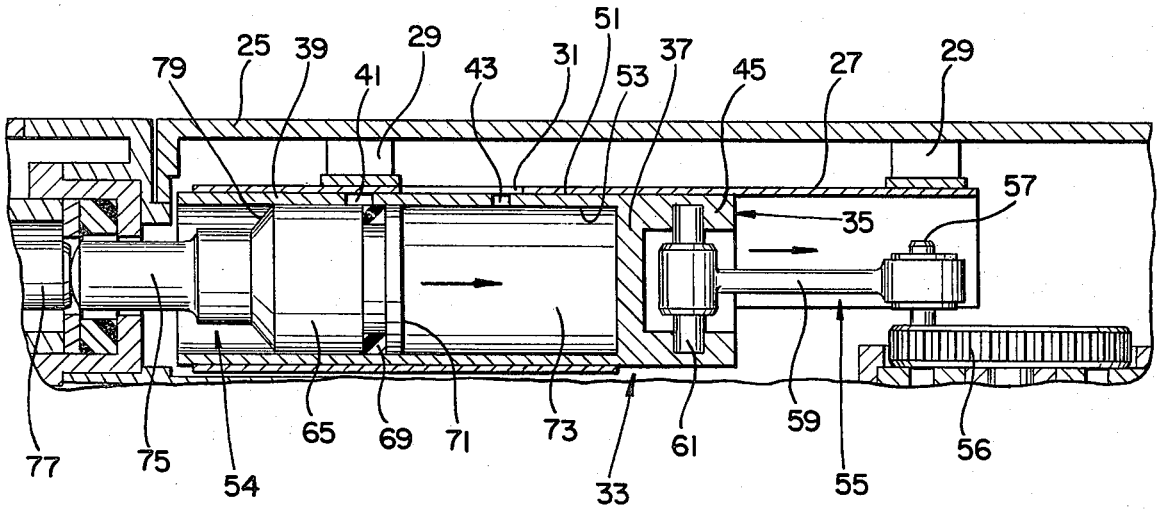

FIG. 7 reflects the reestablishing of the normal operational mode of the unit. The tool bit has been inserted and the device is in place, working on the surface to be operated upon. The ram 54 is displaced axially to the right covering the hole 41. Again, the length of the ram and the axial distance between the end thereof, 71, in the bottom dead center position, is such that the peripheral portion 65 seals off the hole 41 until the radial hole 43 is sealed off from communication with slot 31 by the tube 27. The vacuum created in enclosure 73 results in an acceleration of the ram member 54 to the right and a reinstitution of the operational cycle.

The above described embodiment, of course, is not to be construed as limiting the breadth of the present invention. Modifications, and other alternative constructions will be apparent which are within the spirit and scope of the invention as defined in the appended claims.

For example, whereas the air passageway means in the barrel is described as including a single, elongated slot, this could comprise two separate, axially disposed openings. One would communicate with hole 43 during the operation cycle; while the other would communicate with hole 41 in the idle mode. Nor in this invention need the air replenishing part of the system be disposed radially, about the barrel, where the idling portion of the system is located.

What is claimed is:

1. A hammer tool having a housing which carries a detachable bit toengage a work piece, (a) drive means mounted in the housing to power the tool, (b) a barrel fixedly connected to the housing, and in communication with the atmosphere, (c) the barrel has an open forward end and an open rearward end, (d) an air passageway formed intermediate the ends of the barrel, (e) a piston member slidingly disposed in the barrel, the piston member has a closed end adjacent the rearward end of the barrel, and the piston member has an open end adjacent the forward end of the barrel, (f) the piston member connected to be reciprocated by the drive means, (g) a ram slidingly disposed in the open end of the piston freely to move substantially forward of the open end of the piston member in an idling mode defined by the absence of the bit, and the ram to reciprocate responsive the driven piston member to deliver impact blows to the bit in a hammering mode defined by the presence of the bit, (h) the ram having a sealing surface disposed opposite the closed end of the piston member, (i) a chamber means of variable volume formed in the open end of the piston member between the closed end of the piston member and the sealing surface of the ram, (j) a front port and a rear port formed in the open end of the piston member in predetermined spaced relationship to each other, (k) the rear port to communicate the chamber means with the barrel air passageway upon the piston member reaching the limit of its forward travel to permit replenishing air in the chamber means, and thereafter said communication between the chamber means and the barrel air passageway being selectively closed by the independent motions of the ram or the piston member during the hammering mode, the rear port continuously communicating with the chamber means during the idle mode, and (l) the front port during the hammering mode is closed by the ram, the barrel, or by both the ram and the barrel, the front port to intermittently communicate the barrel air passageway with the chamber means during the idling mode upon the rear port being closed by the barrel and the sealing surface of the ram being disposed forwardly of the front port.

2. The combination claimed in claim 1 wherein:

(a) the ram having a body portion of substantially the same diameter as that of the open end of the piston member to permit substantial sliding and sealing engagement therewith, and (b) the predetermined distance between the front port and the second port is of greater length than the corresponding length of the body portion of the ram.

3. The combination claimed in claim 1 wherein:

(a) the ram having a body portion, and an impact portion extending forwardly from the body portion, (b) an annular groove formed on the body portion adjacent the rear end thereof, (c) a sealing member disposed in the annular groove and to engage the interior surface of the open end of the piston member to permit relative sliding and sealing therebetween, and to define the sealing surface of the ram.

4. The combination claimed in claim 1 wherein:

(a) the barrel air passageway extends axially a predetermined length, and (b) the predetermined axial distance between the front and rear parts is greater than the predetermined length of the barrel air passageway.

5. The combination claimed in claim 4 wherein:

(a) the ram having a body portion and an impact portion extending forwardly from the body portion, and (b) the axial length of the body portion being substantially equal to the axial length of the barrel air passageway.

* * * * *